US007913663B2

(12) United States Patent
Cobbs

(10) Patent No.: US 7,913,663 B2
(45) Date of Patent: Mar. 29, 2011

(54) ROTARY PISTON MACHINE

(76) Inventor: Archibald L. Cobbs, Birmingham, AL (US)

( * ) Notice: Subject to any disclaimer, the term of this patent is extended or adjusted under 35 U.S.C. 154(b) by 406 days.

(21) Appl. No.: 12/154,204

(22) Filed: May 21, 2008

(65) Prior Publication Data

US 2009/0291009 A1 Nov. 26, 2009

(51) Int. Cl.
*F02B 53/00* (2006.01)

(52) U.S. Cl. ..... 123/242; 123/200; 123/241; 418/61.3; 418/48; 418/58

(58) Field of Classification Search ..... 123/200, 123/241, 242; 418/61.3, 48, 58
See application file for complete search history.

(56) References Cited

U.S. PATENT DOCUMENTS 1,277,018 A * 8/1918 Wolfington ..... 418/61.3
3,131,678 A * 5/1964 Peras ..... 418/61.3
3,288,121 A * 11/1966 Linder ..... 418/61.3
3,450,107 A * 6/1969 Radziwill et al. ..... 418/61.3
3,996,901 A * 12/1976 Gale et al. ..... 123/242
4,008,982 A * 2/1977 Traut ..... 418/61.3
4,111,617 A * 9/1978 Gale et al. ..... 418/61.3
6,983,729 B2 * 1/2006 Schapiro et al. ..... 123/242
2006/0065233 A1 * 3/2006 Kim ..... 123/228

* cited by examiner

*Primary Examiner* — Thomas E Denion
*Assistant Examiner* — Mary A Davis
(74) *Attorney, Agent, or Firm* — Cherskov & Flaynik

(57) ABSTRACT

A rotary piston machine 10 includes an enclosure 12 having a cavity 14 therein with arcuate side walls 16*a,b,c* defining a plurality of arcuate recesses 18*a,b,c* and a piston member 20 rotationally disposed in the cavity 14. The piston member 20 includes opposite ends 42 and 43 configured to rotationally engage the arcuate side walls 16*a,b,c* and the arcuate recesses 18*a,b,c* such that compression chambers 26*a,b,c* are ultimately formed via the piston member ends 42 and 43 cooperatively engaging two arcuate recesses 18*a,b,c*. The two piston member ends 42 and 43 each including first and second arcuate edges 44 and 46 that sequentially engage cooperating first and second edge portions 50*a,b,c* and 52*a,b,c* of respective arcuate recesses 18*a,b,c*, resulting in two relatively large seals between one end of the piston member 20 and an arcuate recess 18*a,b,c* during rotation of the piston member 20 until forming compression chambers 26*a,b,c*, thereby preventing a fuel-air mixture from "leaking" during the formation of the compression chambers 26*a,b,c*, resulting in maximum power output from the rotary piston machine 10.

28 Claims, 13 Drawing Sheets

ROTARY PISTON MACHINE

BACKGROUND OF THE INVENTION

1. Field of the Invention

This invention relates to rotary machines including motors, pumps and compressors, and more particularly, to a rotary piston machine having multiple seals between ends of a rotary piston member and arcuate side walls that form a cavity in the rotary piston machine.

2. Background of the Prior Art

Rotary piston machines are well known. United States Patent Application Publication US 2004/0244762, A1, presents a typical rotary piston machine with a myriad of configurations and cooperating machine members that ultimately provide rotary motion.

The problem with prior art rotary piston machines is that a rotating piston member forms a compression or ignition chamber via narrow edge portions of ends of the piston member engaging side walls of a cavity, thereby forming single seals with relatively small lateral dimensions between the ends of the piston member and the side walls, resulting in seals with relatively small surface areas. The small surface areas of the single seals allow a small amount of "leakage" of a fuel-air mixture from the compression chamber before ignition of the fuel-air mixture occurs, thereby reducing the power generated by the quantity of fuel-air mixture "exploded" in the compression chamber.

Another problem with prior art rotary piston machines is that a drive shaft or drive pin that is forcibly rotated by the piston member to ultimately drive a flywheel, is designed to follow a generally circular path with a relatively small diameter. The small diameter path reduces the amount of torque generated by the piston member when forcibly rotated by the exploding fuel-air mixture. Further, the small diameter path promotes a relatively fast piston member rotation. A relatively fast piston member rotation can result in a loss of power when the fuel-air mixture ignites, due to piston member rotation speed expanding the compression chamber at a rate that reduces the force of the ignited expanding gases upon the rotating piston member.

Yet another problem with prior art rotary piston machines is that the piston member includes relatively large lateral dimensions. The large lateral dimensions results in a piston member with a relatively large mass that reduces the power output from the rotary piston machine.

A need exists for a rotary piston machine with single or multiple seals with relatively large surface areas between each end of the rotary piston member and arcuate side walls forming the cavity of the enclosure of the rotary piston machine. Further, a need exists for a rotating piston member with a relatively small lateral dimension to reduce the mass of the piston member. Also, a need exists for a rotary piston machine with a drive pin that follows a relatively large diameter circular path relative to the diameter of the cavity of the enclosure of the machine.

SUMMARY OF THE INVENTION

It is an object of the present invention to overcome many of the disadvantages associated with prior rotary piston machines.

A principal object of the present invention is to maintain pressure in a compression chamber of a rotary piston machine, thereby providing maximum power output upon ignition of a fuel-air mixture in the compression chamber. A feature of the rotary piston machine is one relatively large seal formed via arcuate wall portions of ends of a piston member of the rotary piston machine engaging cooperating arcuate side walls forming a cavity in an enclosure of the machine. Another feature of the machine is two relatively large seals formed via two arcuate edge portions of ends of the piston member engaging cooperating arcuate recesses in the arcuate side walls, the arcuate recesses being separated equal arcuate distances. Still another feature of the machine is a compression chambered ultimately formed via two arcuate edge portions of a first end of the piston member rotationally engaging an arcuate recess, and an arcuate wall portion of a second end of the piston member rotationally engaging an arcuate side wall to ultimately compress a gas-air mixture in the compression chamber formed via the first and second ends of the piston member engaging cooperating arcuate recesses. An advantage of the machine is that the two relatively large seals between the first end of the piston member and an arcuate recess, and the relatively large seal between the second end of the piston member and an arcuate side wall increase seal surface area and integrity, thereby preventing "leakage" of the fuel-air mixture past the first and second ends of the piston member as the piston member rotates to form the compression chamber, resulting in maximum power output from the rotary piston machine when the fuel-air mixture is ignited.

Another object of the present invention is to minimize the rotary force required to rotate a flywheel member of the rotary piston machine. A feature of the machine is the annular movement of a drive pin about the central axis of a flywheel, the drive pin being slidably secured to the piston member, the annular movement of the drive pin about the central axis of the flywheel including a substantially circular configuration with a relatively large diameter. An alternative feature of the machine is the annular movement of a first end of a drive rod about the central axis of the flywheel, the first end of the drive rod being slidably secured to the piston member and a second end of the drive rod being integrally joined to the flywheel, the annular movement of the first end about the central axis of the flywheel including a substantially circular configuration with a relatively large diameter. An advantage of the machine is that torque output is increased without increasing power input. Another advantage of the machine is that the circular rotation of the drive pin or the first end of drive rod promotes a relatively slow piston member movement when the piston member forms a compression chamber, thereby reducing the rate of volume increase of a compression chamber after ignition of the fuel-air mixture, and preventing the rate of volume increase of the compression chamber from reducing the amount of energy generated by an ignited and expanding fuel-air mixture or working medium.

Still another object of the present invention is to minimize the mass of the piston member. A feature of the machine is a piston member with a relatively small lateral dimension. An advantage of the machine is that the volume of the air-fuel mixture to be exploded in the compression chamber is maximized, thereby increasing the power generated by the machine without increasing the volume of the cavity in the enclosure.

Another object of the present invention is to minimize the volume of the compression chamber when the fuel-air mixture in the chamber is ignited. A feature of the machine is disposing the drive pin or the first end of the drive rod at a midpoint of the piston member when igniting the fuel-air mixture. An advantage of the machine is the prevention of the locking of the piston member during the compression and explosion sequence of the fuel-air mixture in the rotary piston machine. Another advantage of the machine is that the power output from the machine is maximized.

Briefly, the invention provides a rotary machine comprising an enclosure having a cavity with arcuate side walls, said arcuate side walls defining a plurality of arcuate recesses; a piston member rotationally disposed in said cavity, said piston member having end portions configured to rotationally engage said arcuate side walls and said arcuate recesses such that a compression chamber is ultimately provided between said arcuate side walls of said cavity and said piston member; means for converting piston member movement into rotary motion imparted upon a flywheel; means for supplying a working medium to predetermined portions of said cavity; means for igniting said working medium; and means for removing spent working medium from predetermined portions of said cavity, whereby, said arcuate side walls of said cavity sequentially cooperate with said piston member to provide sequential compression chambers that ultimately receive said working medium to ultimately provide rotary motion to said flywheel, which provides rotary motion to a machine via a drive shaft.

The invention also provides a rotary pump comprising an enclosure having a cavity with arcuate side walls, said arcuate side walls defining a plurality of arcuate recesses; a piston member rotationally disposed in said cavity, said piston member having end portions configured to rotationally engage said arcuate side walls and said arcuate recesses such that a pumping chamber is ultimately provided between said arcuate side walls and said piston member; means for imparting rotary motion upon a piston member; means for supplying a selected medium to said chamber; means for removing the selected medium from said chamber after the selected medium has been pressurized by said rotating piston member; means for providing the selected medium to a sequential pumping chamber for pressurization by said rotating piston member; and means for removing the selected medium from said sequential pumping chamber.

The invention further provides a method for providing a rotary piston machine, said method comprising the step of providing an enclosure having a cavity with arcuate side walls, said arcuate side walls defining a plurality of arcuate recesses; providing a piston member rotationally disposed in said cavity, said piston member having end portions configured to rotationally engage said arcuate side walls and said arcuate recesses such that a compression chamber is ultimately provided between said arcuate side walls of said cavity and said piston member; converting said piston member movement into rotary motion imparted upon a flywheel; supplying a working medium to predetermined portions of said cavity; igniting said working medium via a plurality of igniters; and removing said working medium from predetermined portions of said cavity, whereby, said arcuate side walls of said cavity sequentially cooperate with said piston member to provide sequential compression chambers that ultimately receive said working medium to ultimately provide rotary motion to said flywheel, which provides rotary motion to a machine via a drive shaft.

BRIEF DESCRIPTION OF THE DRAWINGS

These and other objects, advantages and novel features of the present invention, as well as details of an illustrative embodiment thereof, will be more fully understood from the following detailed description and attached drawings, wherein:

FIG. 1 a depicts a second end of the drive pin secured to the flywheel.

DESCRIPTION OF THE PREFERRED EMBODIMENT

Figure 1:
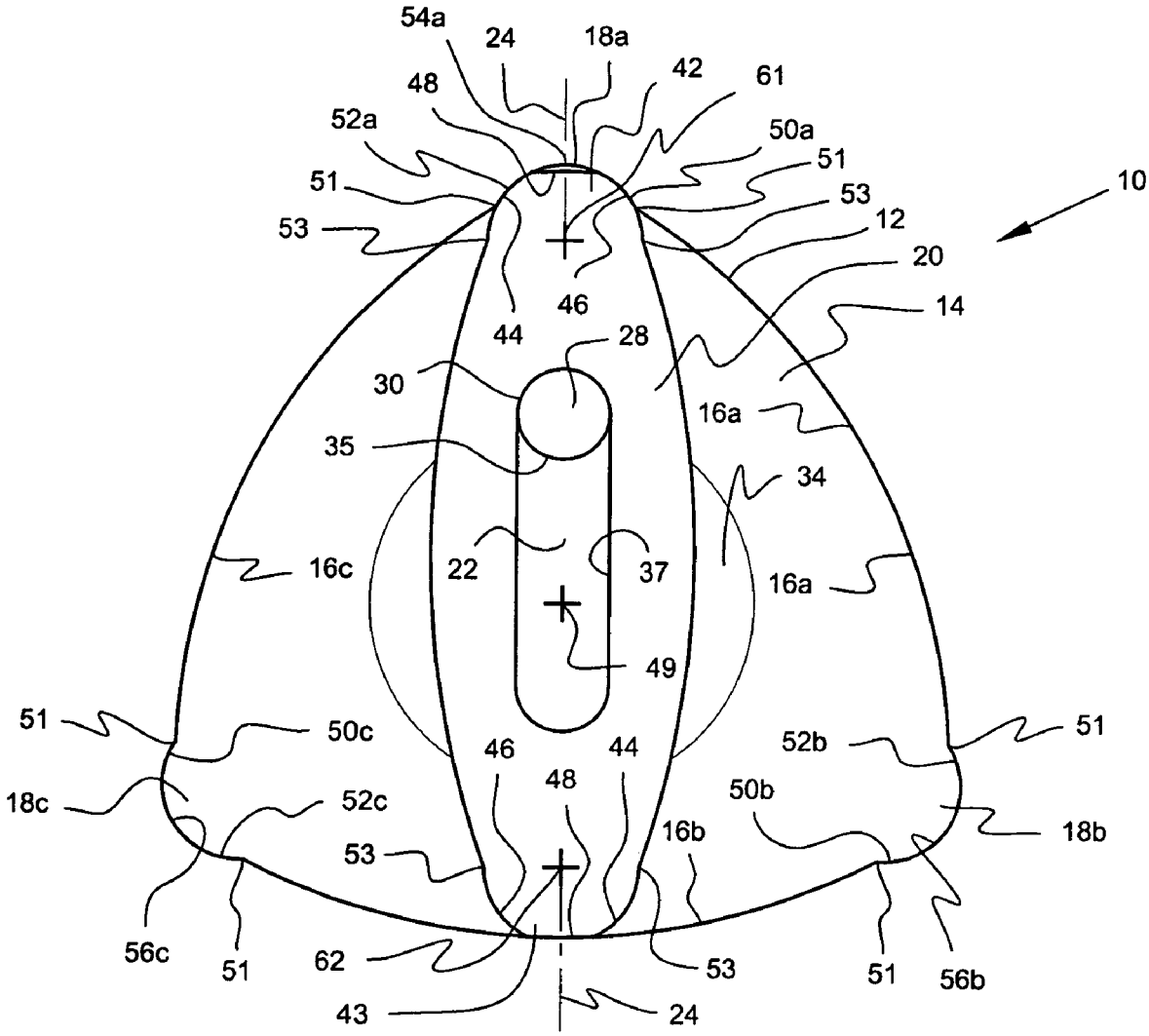
FIG. 1 depicts a rotary piston member in a cavity of an enclosure, the rotary piston member is vertically disposed such that a longitudinal axis of the rotary piston member bisects a first arcuate recess, a drive pin, first and second ends of the rotary piston member, a flywheel and a second arcuate side wall opposite the first arcuate recess in accordance with the present invention.
Figure 1A:
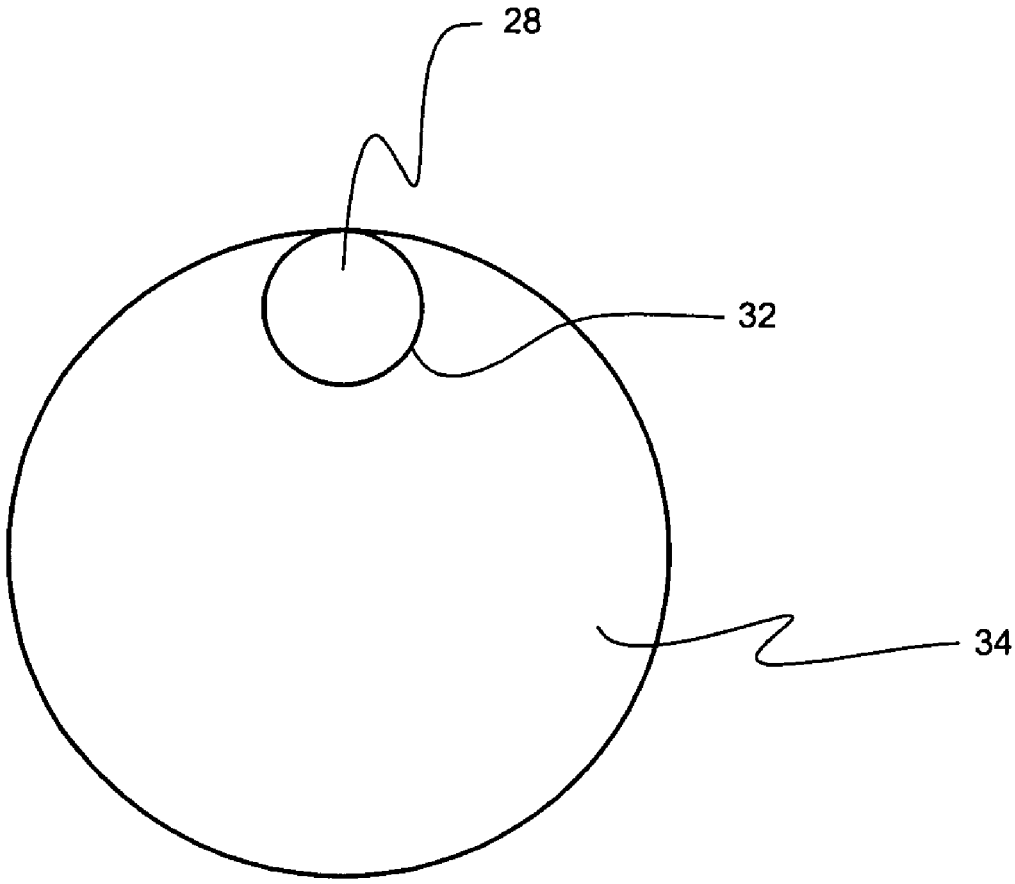

Referring now to the drawings, a rotary piston machine in accordance with the present invention is denoted by numeral 10. The rotary piston machine 10 can be designed to function as a motor, pump or compressor, the machine 10 including components common to all designs and well known to those of ordinary skill in the art. The rotary piston machine 10 includes an enclosure 12 having a cavity 14 therein with first, second and third arcuate side walls 16*a,b,c* defining a plurality of first, second and third arcuate recesses 18*a,b,c;*, and a piston member 20 rotationally disposed in the cavity 14. The piston member 20 includes a longitudinal slot 22 axially aligned with a longitudinal axis 24 of the piston member 20, and first and second ends 42 and 43 configured to rotationally engage the arcuate side walls 16*a,b,c*, and the arcuate recesses 18*a,b,c*, such that compression chambers 26*a,b,c*, are ultimately provided between the arcuate recesses 18*a,b,c*, and the piston member 20. The piston member 20 further includes a relatively small lateral dimension to minimize piston member 20 mass and to maximize a volume of a working medium that is ultimately compressed, thereby increasing power generated by the rotary machine 10 without increasing the volume of the cavity 14. Although the rotary piston machine 10 is depicted and described throughout the specification as having three arcuate side walls 16*a,b,c*, and having a piston member 20 with two ends 42 and 43, the inventive concept included herein can be expanded to include a cavity 14 with more than three arcuate side walls and a piston member 20 configuration with more than two ends or perturbations.

The rotary machine 10 further includes a drive pin 28 having a first end 30 slidably secured to the piston member 20 via the longitudinal slot 22, and a second end 32 secured to a flywheel 34. The drive pin 28 moves lineally in alternating directions across the longitudinal slot 22, while simultaneously moving annularly (clockwise or counter-clockwise) about a central axis 49 of the flywheel 34. The annular movement of the drive pin 28 includes a substantially circular configuration or path with a relatively large diameter, thereby minimizing the rotary force required to rotate the flywheel 34. The annular movement of the drive pin 28 promotes a relatively slow piston member 20 movement when the piston member 20 is disposed adjacent to the arcuate side walls 16*a,b,c*, of the cavity 14, thereby reducing the rate of volume increase of compression chambers 26*a,b,c*, after ignition of the working medium in the compression chambers 26*a,b,c*, and increasing the amount of power generated by an expanding working medium.

The configuration and dimensions of the piston member 20, including the relatively small lateral dimension of the piston member 20, cooperate with the dimensions of the drive pin 28 and the diameter of the circular path "traveled" by the drive pin 28 to achieve a preselected power output specification for the rotary piston machine 10, while minimizing the cost to construct the machine 10. The selected configurations and dimensions of the piston member 20 and drive pin 28 specified to achieve the required power output are determined via computer simulation well known to those of ordinary skill in the art.

The drive pin 28 cooperates with the rotary movement of the piston member 20 to provide rotary motion to the flywheel 34 via an edge portion 35 of the drive pin 28 slidably and rotationally engaging a cooperating channel portion 37 of the piston member 20. A working medium (not depicted) such as a combination of air and fuel (gas or diesel fuel, for example) is supplied to a compression chamber 26*a*, (see FIG. 2, the only figure depicting valves and spark plugs) via one or more intake valves 36*a*. One or more spark plugs 38*a* or similar ignitor components are provided for initiating an "explosion" of the working medium within the compression chamber 26*a*. One or more exhaust valves 40*a*, is provided for removing spent working medium (not depicted) from the compression chamber 26*a*, whereby the arcuate side walls 16*a,b,c*, of the cavity 14 sequentially cooperate with the piston member 20 to provide sequential compression chambers 26*a,b,c*, that ultimately receive, explode and remove the working medium via intake valves 36*a*,63*b*,36*c*, spark plugs 38*a*,38*b*,38*c*, and exhaust valves 40*a*,40*b*,40*c*, to ultimately provide rotary motion to the flywheel 34, which imparts rotary motion to a machine (not depicted) via a drive shaft (not depicted). Each one of the intake valves 36*a*,36*b*,36*c*, spark plugs 38*a*,38*b*, 38*c* and exhaust valves 40*a*,40*b*,40*c*, are operated once during each rotation of the drive shaft. Configurations and placement of the intake valves 36*a*,36*b*,36*c*, spark plugs 38*a*,38*b*,38*c*, and exhaust valves 40*a*,40*b*,40*c*, through the side walls 16*a, b,c*, may vary a myriad of ways, including but not limited to replacing the intake and exhaust valves 36*a*,36*b*,36*c*, and 40*a*,40*b*,40*c*, with ports; and disposing an intake valve 36*a*, 36*b*,36*c*, adjacent to a first edge portion 50*a,b,c*, of each of the arcuate recess 18*a,b,c*, disposing a corresponding exhaust valve 40*a*,40*b*,40*c* adjacent to a second edge portion 52*a,b,c*, of each recess 18*a,b,c*, and disposing spark plugs 38*a*,38*b*, 38*c*, at midpoints in each arcuate side wall 16*a,b,c*. Further, the rotary machine 10 may be designed to include only one intake valve 36*a*,36*b*,36*c*, one spark plug 38*a*,38*b*,38*c*, and one exhaust valve 40*a*,40*b*,40*c*, through one arcuate side wall 16*a,b,c*, thereby simplifying the design of the machine 10 but reducing the number of power "strokes" from three to one for every one hundred and eighty degrees of piston member 20 rotation or three hundred and sixty degrees of flywheel 34 rotation.

Figure 14:
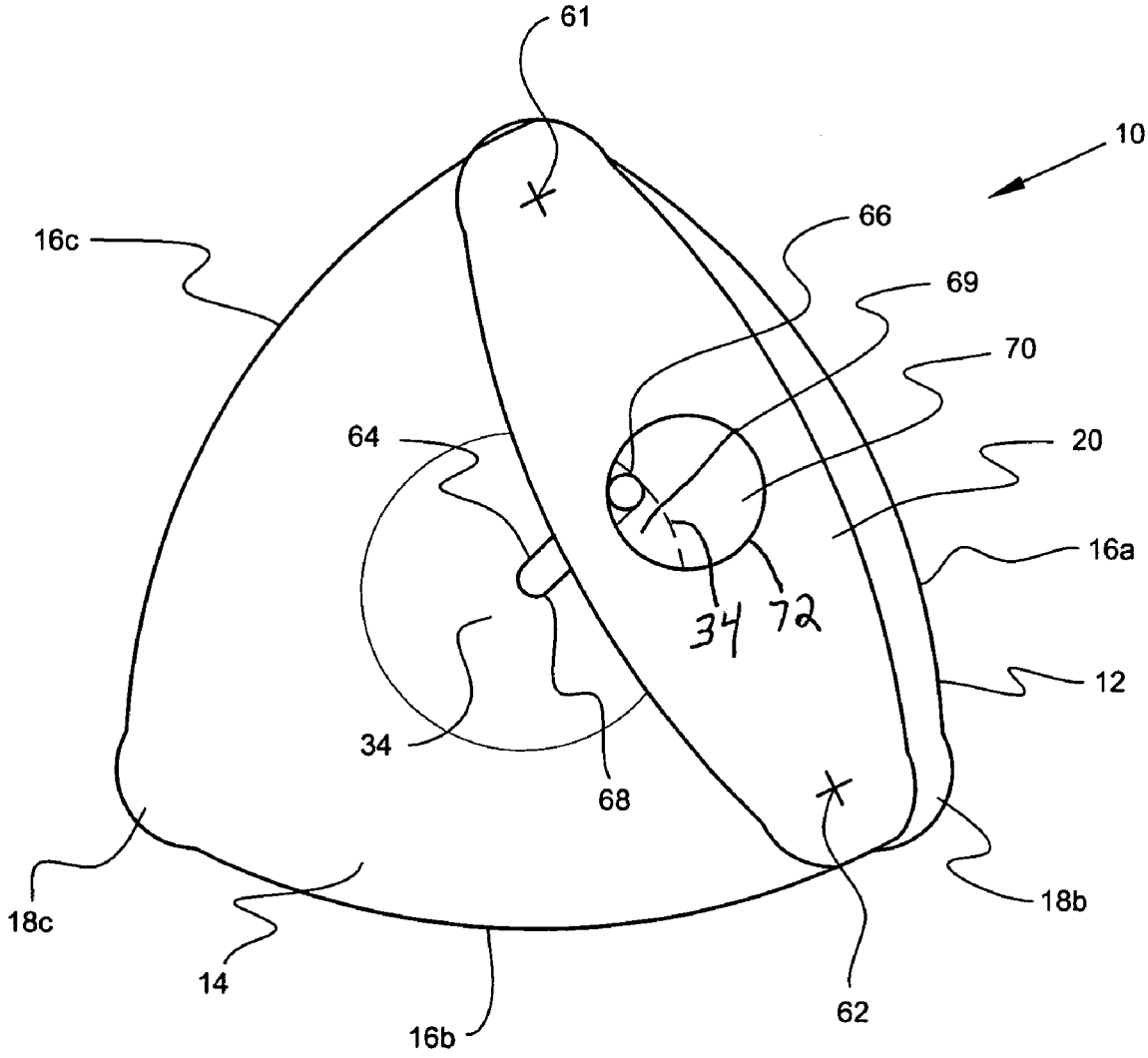
FIG. 14 depicts an alternative embodiment for the rotary drive mechanism that links the rotary piston member to the flywheel.

Referring to FIG. 14, an alternative embodiment for the piston member 20-drive pin 28 communication is depicted. The alternative embodiment includes a drive rod 64 having first and second ends 66 and 68 with means (well known to those of ordinary skill in the art) to secure the first end 66 to an edge portion 69 of an annular plate 70, which is rotationally disposed (via means well known to those or ordinary skill in the art) in an aperture 72 in a central portion of the piston member 20. The second end 68 of the drive rod 64 is secured to a central portion of the flywheel 34. The first end 66 of the drive rod 64 moves clockwise or counter-clockwise about the aperture 72 and with the same rotation as the flywheel 34. The drive rod 64 responds to the rotary movement of the piston member 20 to provide rotary motion to the flywheel 34.

The enclosure 12, piston member 20, drive pin 28, drive rod 64 and flywheel 34 are fabricated from carbon steel or similar durable material well known to those of ordinary skill in the art. The enclosure 12, cavity 14, piston member 20 and flywheel 34 are dimensioned and configured including cooperating axial specifications to provide preselected power parameters when the rotary piston machine 10 is used as a motor, or preselected volume quantities when the rotary machine 10 is used as a pump or a compressor via specification means well known to those or ordinary skill in the art.

The arcuate recesses 18*a,b,c*, are separated substantially about one-hundred and twenty degrees about the cavity 14. The arcuate recesses 18*a,b,c*, have equal and relative small degrees of arc when compared to the arcuate side walls 16*a, b,c*, of the cavity 14. The arcuate recesses 18*a,b,c*, are configured and dimensioned to snugly receive first and second ends 42 and 43 of the rotating piston member 20 such that a relatively small "gap" is maintained between inner arcuate walls 56*a,b,c*, of the arcuate recesses 18*a,b,c*, and first and second arcuate edge portions 44 and 46 of the first and second ends 42 and 43. The first and second ends 42 and 43 include arcuate wall portions 48 disposed between the first and second arcuate edge portions 44 and 46. The arcuate wall portions 48 are configured and dimensioned to be congruently disposed adjacent to cooperating arcuate side walls 16*a,b,c*, of the cavity 14 such that a relatively small gap is maintained between the arcuate side walls 16*a,b,c*, and the arcuate wall portions 48. The "gaps" between the first and second ends 42 and 43 of the rotating piston member 20, and the arcuate side walls 16*a,b,c*, and arcuate recess 18*a,b,c*, are ultimately "filled" with oil or similar sealing lubricant, well known to those of ordinary skill in the art, to prevent compressed fuel-air mixtures from leaking from compression chambers 26*a, b,c*, ultimately formed by the rotating piston member 20.

The radius of arc is the same for each arcuate recess 18*a, b,c*, but the dimension of the radius of arc may vary pursuant to the compression parameters of the fuel-air mixture in the compression chambers 26*a,b,c*, at the moment of ignition. The greater the required compression of the fuel-air mixture, the greater the degree of arc for the arcuate recesses 18*a,b,c*, and the first and second arcuate edges 44 and 46 of the ends 42 and 43 of the piston member, thereby providing larger area of engagement between the ends 42 and 43 and the arcuate recesses 18*a,b,c* to prevent the fuel-air mixture from "leaking" from the compression chamber 26. The smaller the compression of the fuel-air mixture, the smaller the degree of arc of the arcuate recesses 18*a,b,c*, and the first and second arcuate edges 44 and 46 of the ends 42 and 43. The "volume" of the arcuate recesses 18*a,b,c*, is maintained relatively small compared to the volume of the cavity 14 to maintain a relatively small gap 54 between the ends 42 and 43 and cooperating inner arcuate walls 56 of the arcuate recesses 18*a,b,c*, thereby preventing "leakage" of a compressed fuel-air mixture from the compression chambers 26*a,b,c*, past the two seals formed by the arcuate edges 44 and 46 engaging cooperating arcuate recesses 18*a,b,c*.

Irrespective of the preselected dimensions for the compression chambers 26*a,b,c*, the configurations of the first and second edge portions 44 and 46 of the first end 42 include a radius of circular arc with a center 61 at the first end 42. The configuration of the arcuate wall portion 48 of the first end includes a radius of circular arc with a center 62 at the second end 43. The configurations of the first and second edge portions 44 and 46 of the second end 43 include a radius of circular arc with a center 62 at the second end 43. The configuration of the arcuate wall portion 48 of the second end includes a radius of circular arc with a center 61 at the first end 42. The radius of circular arc of the first and second edge portions 44 and 46 of the first and second ends 42 and 43 is slightly less than the radius of circular arc of the arcuate recesses 18*a,b,c*, to provide a relatively small gap between the first and second ends 42 and 43, and the arcuate recesses 18*a,b,c*. The radius of circular arc of the arcuate wall portions 48 of the first and second ends 42 and 43 is slightly less than the radius of circular arc of the arcuate side walls 16*a,b,c*, to provide a relatively small gap between the first and second ends 42 and 43, and the arcuate side walls 16*a,b,c*. The configurations and dimensions of the first and second ends 42 and 43, arcuate side walls 16*a,b,c*, and the arcuate recesses 18*a,b,c*, cooperate to provide substantially congruent positioning between cooperating and separated surfaces at all times as the piston member 20 rotates within the cavity 14.

The cavity 14 is configured by disposing an arcuate recesses 18*a,b,c*, between arcuate side walls 16*a,b,c*. The recesses 18*a,b,c*, include first and second edge portions 50*a, b,c*, and 52*a,b,c* with discontinuity edges 51 which provide a "non-smooth" or discontinuous transition between an arcuate side wall 16*a,b,c*, and an arcuate recess 18*a,b,c*. The discontinuity edges 51 snugly insert into cooperating discontinuity recesses 53 disposed between the first and second ends 42 and 43, and the arcuate wall portion 60 of the rotating piston member 20, resulting in compression chambers 26*a,b,c*, with smaller volumes and higher compression ratios, and seals with larger surface areas formed by cooperating portions of the arcuate recesses 18*a,b,c*, and portions of the ends 42 and 43 of the piston member 20. The increased surface area of the seals promote "tighter" compression chambers 26*a,b,c*, that prevent the relatively higher compressed air-fuel mixtures therein from leaking from the compression chambers 26*a,b,c*.

Referring to FIG. 1, in operation, the piston member 20 is rotating counter-clockwise about a piston member first end center 61, resulting in a relatively slow rotation of the first end 42 of the piston member 20 about the inner arcuate wall 56*a*, of the first arcuate recess 18*a*, and a relatively fast movement of the second end 43 of the piston member 20 about the second arcuate side wall 16*b*, of the cavity 14. The first arcuate edge portion 44 of the first end 42 of the piston member 20 is depicted engaging a second edge 52*a*, of the first arcuate recess 18*a*, and the second arcuate edge portion 46 is depicted engaging a first edge portion 50*a*, of the first arcuate recess 18*a*, thereby providing two seals with relatively large surface areas between the first end 42 and the inner arcuate wall 56*a*, of the first arcuate recess 18*a*. The arcuate wall portion 48 of the second end 43 of the rotating piston member 20 is depicted cooperatively engaging the second arcuate side wall 16*b*, of the cavity 14, thereby providing a seal with a relatively large surface area between the second end 43 and the second arcuate side wall 16*b*.

The two relatively large seals of the first end 42 and the large surface area seal of the second end 43 prevent the "leaking" of a fuel-air mixture past the first and second ends 42 and 43, while the rotating piston member 20 compresses the fuel-air mixture supplied to the cavity 14 via intake valves 36*a*. The piston member 20 continues rotating until the second end 43 of the piston member 20 engages the second arcuate recess 18*b*, and the fuel-air mixture is compressed to a predetermined pressure. In the event that a relatively small quantity of fuel-air mixture should leak past the seal formed by the second arcuate edge portion 46 of the first end 42 and the first edge portion 50*a*, of the first arcuate recess 18*a*, during compression of the fuel-air mixture, the "leakage" quantity will be "vented" to and ultimately burned in compression chambers 26*b* formed during the operation of the rotary piston machine 10.

Figure 2:
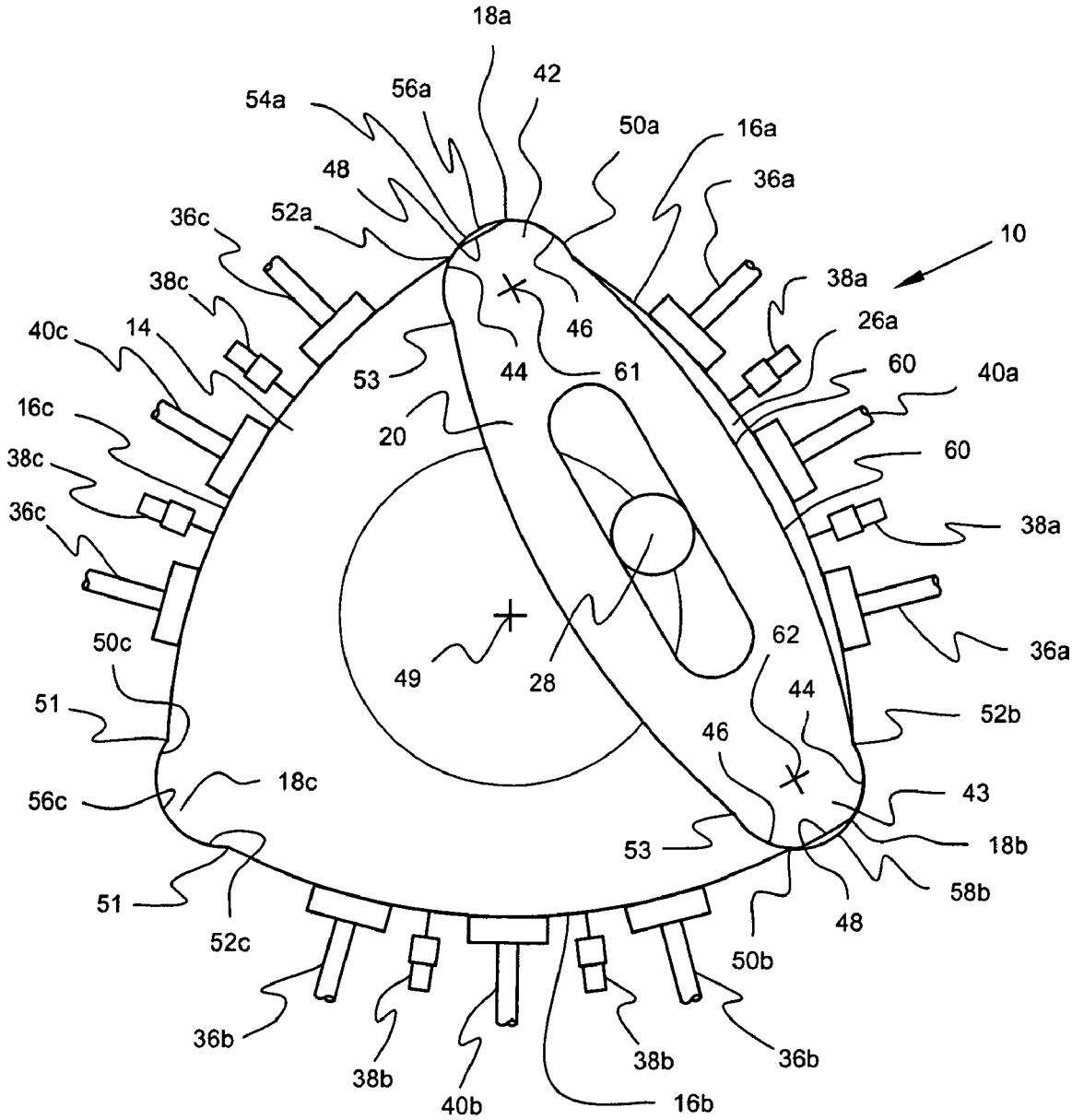
FIG. 2 depicts the rotary piston member in the cavity of the enclosure of FIG. 1, but with the rotary piston member rotated such that the first end of the rotary piston member engages the first arcuate recess, and such that the second end of the rotary piston member engages a second arcuate recess, thereby forming a compression chamber sealed via two arcuate edges on the first end of the rotary piston member engaging cooperating portions of the first arcuate recess, and two arcuate edges on the second end of the rotary piston member engaging cooperating portions of the second arcuate recess.

Referring to FIG. 2, the second end 43 of the piston member 20 has rotated counter-clockwise about the piston member first end center 61, such that the second end 43 of the piston member 20 engages the second arcuate recess 18*b;*, whereupon, the piston member 20 rotation stops momentarily, the center of rotation of the piston member 20 changes to a piston member second end center 62, the first arcuate edge portion 44 of the first end 42 disengages from the second edge portion 52*a*, of the first arcuate recess 18*a*, to allow the arcuate wall portion 48 of the first end 42 to ultimately engage the third arcuate side wall 16*c*, of the cavity 14, and the entire surface of the second arcuate edge portion 46 of the first end 42 engages the first edge portion 50*a*, of the first arcuate recess 18*a*, thereby providing a relatively small gap 54*a*, between arcuate wall portion 48 of the first end 42 and inner arcuate wall 56*a*, of the first arcuate recess 18*a*, while providing a relatively large seal area between the second arcuate edge portion 46 of the first end 42 and the first arcuate recess 18*a*. Further, when the piston member 20 momentarily stops rotation, the entire surface of the first arcuate edge portion 44 of the second end 43 engages the second edge portion 52*b*, of the second arcuate recess 18*b*, and the second arcuate edge portion 46 of the second end 43 remains disengaged from the first edge portion 50*b*, of the second arcuate recess 18*b*, thereby providing a relatively small gap 58*b*, between the second end 43 and an inner arcuate wall 56*b*, of the second arcuate recess 18*b*, and forming a compression chamber 26*a*, with a compressed fuel-air mixture therein pressurized to a predetermined magnitude between an arcuate wall portion 60 of the rotating piston member 20 and a corresponding first arcuate side wall 16*a*, of the cavity 14.

The compression chamber 26*a*, volume is minimized and the fuel-air mixture pressure maximized when the drive pin 28 is disposed at a midpoint of the piston member 20 and the first and second ends 42 and 43 of the piston member 20 engage the first and second arcuate recesses 18*a*, and b, thereby preventing the piston member 20 from locking during the compression and explosion sequence of the compression chamber 26*a*. Spark plugs 38*a*, then ignite the fuel-air mixture causing an "explosion" of the fuel-air mixture, resulting in the continuation of the forcible rotation of the piston member 20 in a counter-clockwise motion. The spent fuel-air mixture is ultimately removed from the cavity 14 via exhaust valves 40*a*.

Figure 3:
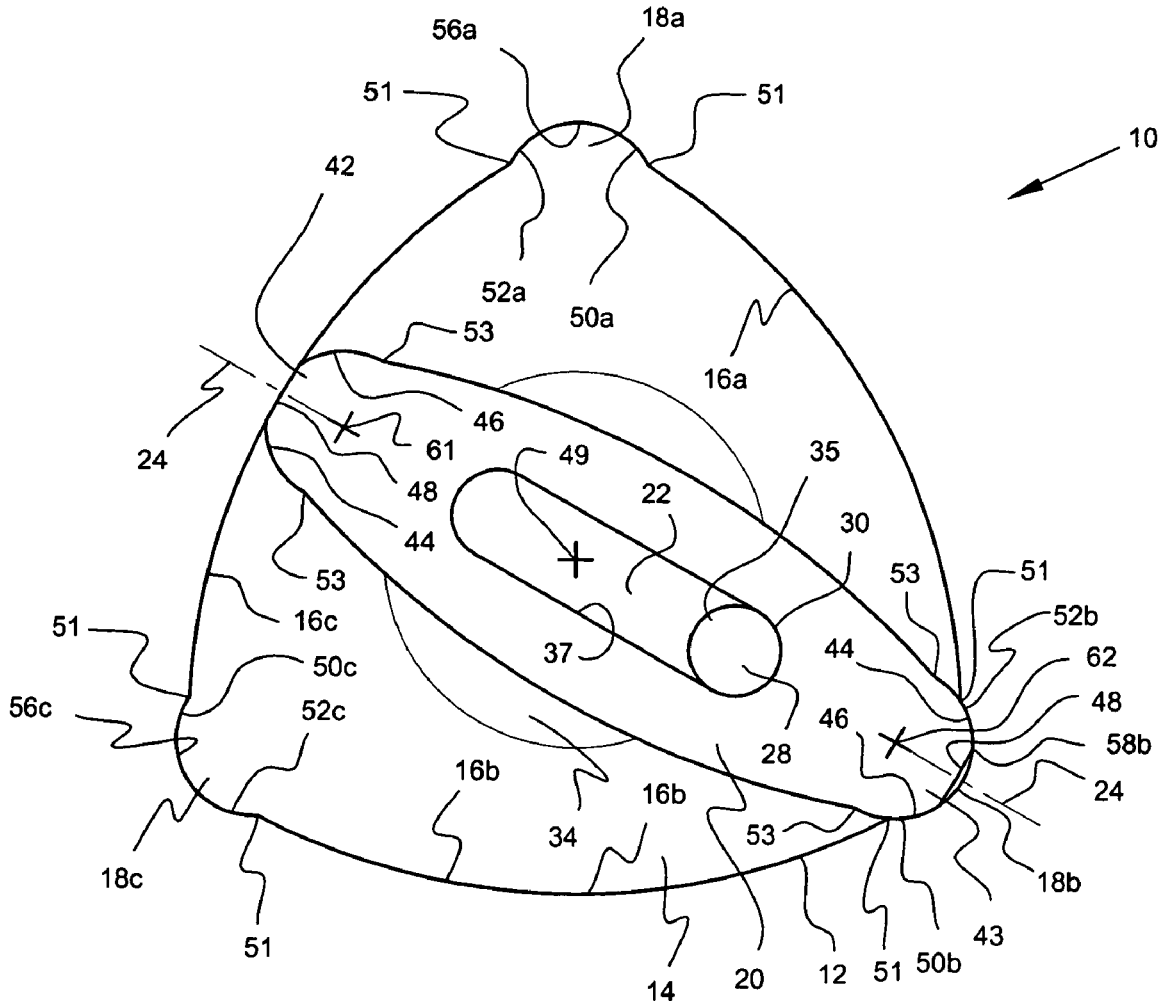
FIG. 3 depicts the rotary piston member in the cavity of the enclosure of FIG. 2, but with the rotary piston member rotated such that the longitudinal axis of the rotary piston member bisects the second arcuate recess, the drive pin, first and second ends of the rotary piston member, and a third arcuate side wall opposite the second arcuate recess in accordance with the present invention.

Referring to FIG. 3, the piston member 20 has continued a counter-clockwise rotation about the second end center 62, resulting in a relatively slow rotation of the second end 43 of the piston member about the inner arcuate wall 56*b*, of the second arcuate recess 18*b*, and a relatively fast movement of the first end 42 of the piston member 20 about the third arcuate side wall 16*c* of the cavity 14. The first arcuate edge portion 44 of the second end 43 of the piston member 20 is depicted engaging a second edge 52*b*, of the second arcuate recess 18*b*, and the second arcuate edge portion 46 is depicted engaging a first edge portion 50*b*, of the second arcuate recess 18*b*, thereby providing two seals between the second end 43 and the inner arcuate wall 56*b*, of the first arcuate recess 18*a*. The arcuate wall portion 48 of the first end 42 of the rotating piston member 20 is depicted cooperatively engaging the third arcuate side wall 16*c*, of the cavity 14, thereby providing a seal with a relatively large surface area between the first end 42 and the third arcuate side wall 16*c*.

The two relatively large seals of the second end 43 and the large surface area seal of the first end 42 prevent the "leaking" of a fuel-air mixture past the first and second ends 42 and 43, while the rotating piston member 20 compresses the fuel-air mixture supplied to the cavity 14 via intake valves 36*b*. The piston member 20 continues rotating until the first end 42 of the piston member 20 engages the third arcuate recess 18*c*, and the fuel-air mixture is compressed to a predetermined pressure. In the event that a relatively small quantity of fuel-air mixture should leak past the seal formed by the first arcuate edge portion 44 of the second end 43 and the second edge portion 52*b*, of the second arcuate recess 18*b*, during compression of the fuel-air mixture, the "leakage" quantity will be "vented" to and ultimately burned in compression chamber 26*c* formed during the operation of the rotary piston machine 10.

Figure 4:
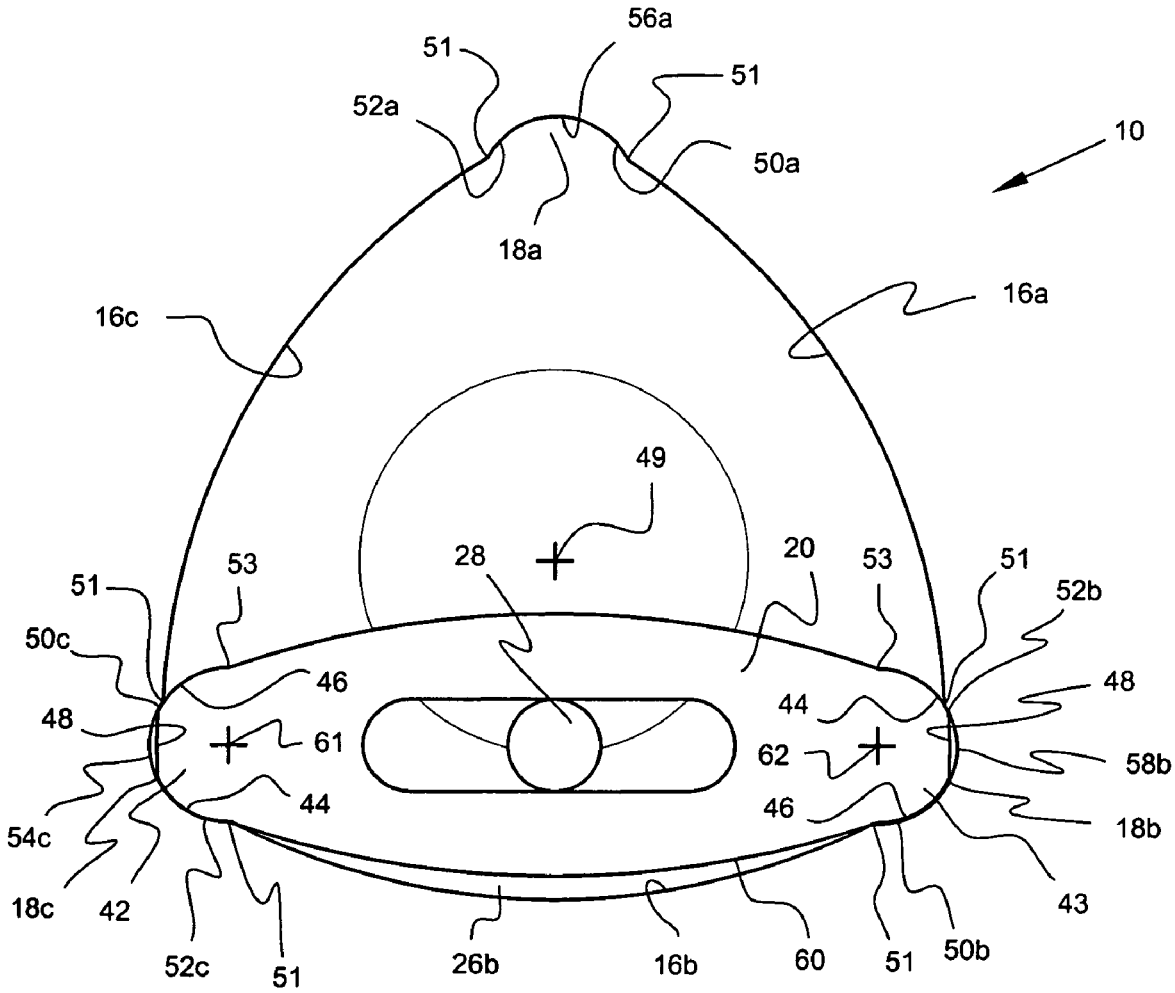
FIG. 4 depicts the rotary piston member in the cavity of the enclosure of FIG. 3, but with the rotary piston member rotated such that the first end of the rotary piston member engages a third arcuate recess, and such that the second end of the rotary piston member engages the second arcuate recess, thereby forming a compression chamber sealed via the two arcuate edges on the first end of the rotary piston member engaging cooperating portions of the third arcuate recess, and the two arcuate edges on the second end of the rotary piston member engaging cooperating portions of the second arcuate recess.

Referring to FIG. 4, the first end 42 of the piston member 20 has rotated counter-clockwise about the piston member second end center 62, such that the first end 42 of the piston member 20 engages the third arcuate recess 18*c*;, whereupon, the piston member 20 rotation stops momentarily, the center of rotation of the piston member 20 changes back to the piston member first end center 61, the first arcuate edge portion 44 of the second end 43 disengages from the second edge portion 52*b*, of the second arcuate recess 18*b*, to allow the arcuate wall portion 48 of the second end 43 to ultimately engage the first arcuate side wall 16*a*, of the cavity 14, and the entire surface of the first arcuate edge portion 44 of the first end 42 engages the second edge portion 52*c*, of the third arcuate recess 18*c*, thereby providing a relatively small gap 58*b*, between the second end 43 and inner arcuate wall 56*b*, of the second arcuate recess 18*b*, and providing a relatively large seal area between the second end 43 and the second arcuate recess 18*b*. Further, when the piston member 20 momentarily stops rotation, the entire surface of the first arcuate edge portion 44 of the first end 42 engages the second edge portion 52*c*, of the third arcuate recess 18*c*, and the second arcuate edge portion 46 of the first end 42 remains disengaged from the first edge portion 50*c*, of the third arcuate recess 18*c*, thereby providing a relatively small gap 54*c*, between the first end 42 and an inner arcuate wall 56*c*, of the third arcuate recess 18*c*, and forming a compression chamber 26*b*, with a compressed fuel-air mixture therein pressurized to a predetermined magnitude between an arcuate wall portion 60 of the rotating piston member 20 and a corresponding second arcuate side wall 16*b*, of the cavity 14.

The compression chamber 26*b*, volume is minimized and the fuel-air mixture pressure maximized when the drive pin 28 is disposed at a midpoint of the piston member 20 and the first and second ends 42 and 43 of the piston member 20 engage the second and third arcuate recesses 18*b*, and c, thereby preventing the piston member 20 from locking during the compression and explosion sequence of the compression chamber 26*b*. Spark plugs 38*b*, then ignite the fuel-air mixture causing an "explosion" of the fuel-air mixture, resulting in the continuation of the forcible rotation of the piston member 20 in a counter-clockwise motion. The spent fuel-air mixture is ultimately removed from the cavity 14 via exhaust valves 40*b*.

Figure 5:
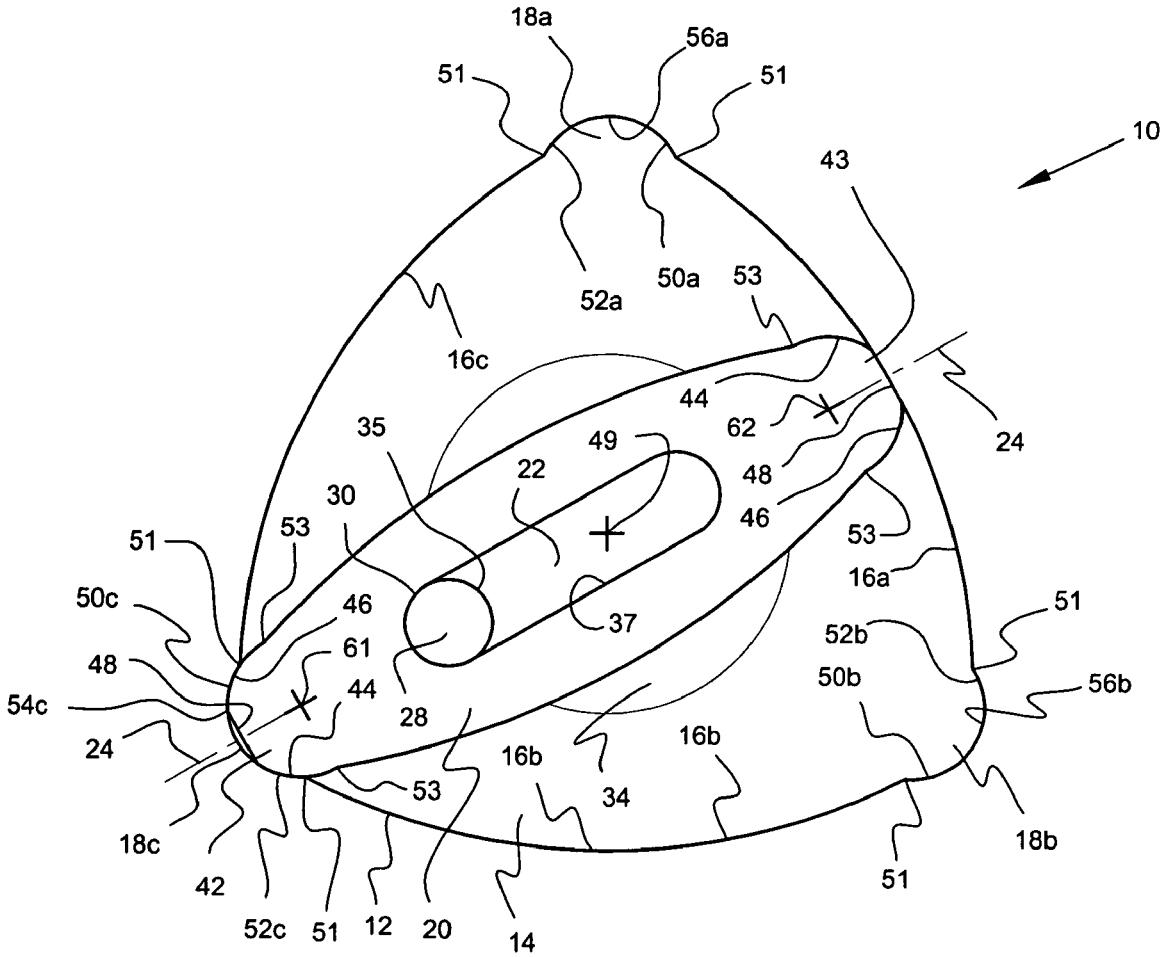
FIG. 5 depicts the rotary piston member in the cavity of the enclosure of FIG. 4, but with the rotary piston member rotated such that the longitudinal axis of the rotary piston member bisects the third arcuate recess, the drive pin, first and second ends of the rotary piston member, and a first arcuate side wall opposite the third arcuate recess in accordance with the present invention.

Referring to FIG. 5, the piston member 20 has continued a counter-clockwise rotation about the first end center 61, resulting in a relatively slow rotation of the first end 42 of the piston member 20 about the inner arcuate wall 56*c*, of the third arcuate recess 18*c*, and a relatively fast movement of the second end 43 of the piston member 20 about the first arcuate side wall 16*a*, of the cavity 14. The first arcuate edge portion 44 of the first end 42 of the piston member 20 is depicted engaging a second edge 52*c*, of the third arcuate recess 18*c*, and the second arcuate edge portion 46 is depicted engaging a first edge portion 50*c*, of the third arcuate recess 18*c*, thereby providing two seals between the first end 42 and the inner arcuate wall 56*c*, of the third arcuate recess 18*c*. The arcuate wall portion 48 of the second end 43 of the rotating piston member 20 is depicted cooperatively engaging the first arcuate side wall 16*a*, of the cavity 14, thereby providing a seal with a relatively large surface area between the second end 43 and the first arcuate side wall 16*a*.

The two relatively large seals of the first end 42 and the large surface area seal of the second end 43 prevent the "leaking" of a fuel-air mixture past the first and second ends 42 and 43, while the rotating piston member 20 compresses the fuel-air mixture supplied to the cavity 14 via intake valves 36*c*. The piston member 20 continues rotating until the second end 43 of the piston member 20 engages the first arcuate recess 18*a*, and the fuel-air mixture is compressed to a predetermined pressure. In the event that a relatively small quantity of fuel-air mixture should leak past the seal formed by the first arcuate edge portion 44 of the first end 42 and the second edge portion 52*c*, of the third arcuate recess 18*c*, during compression of the fuel-air mixture, the "leakage" quantity will be "vented" to and ultimately burned in compression chamber 26*a* formed during the operation of the rotary piston machine 10.

Figure 6:
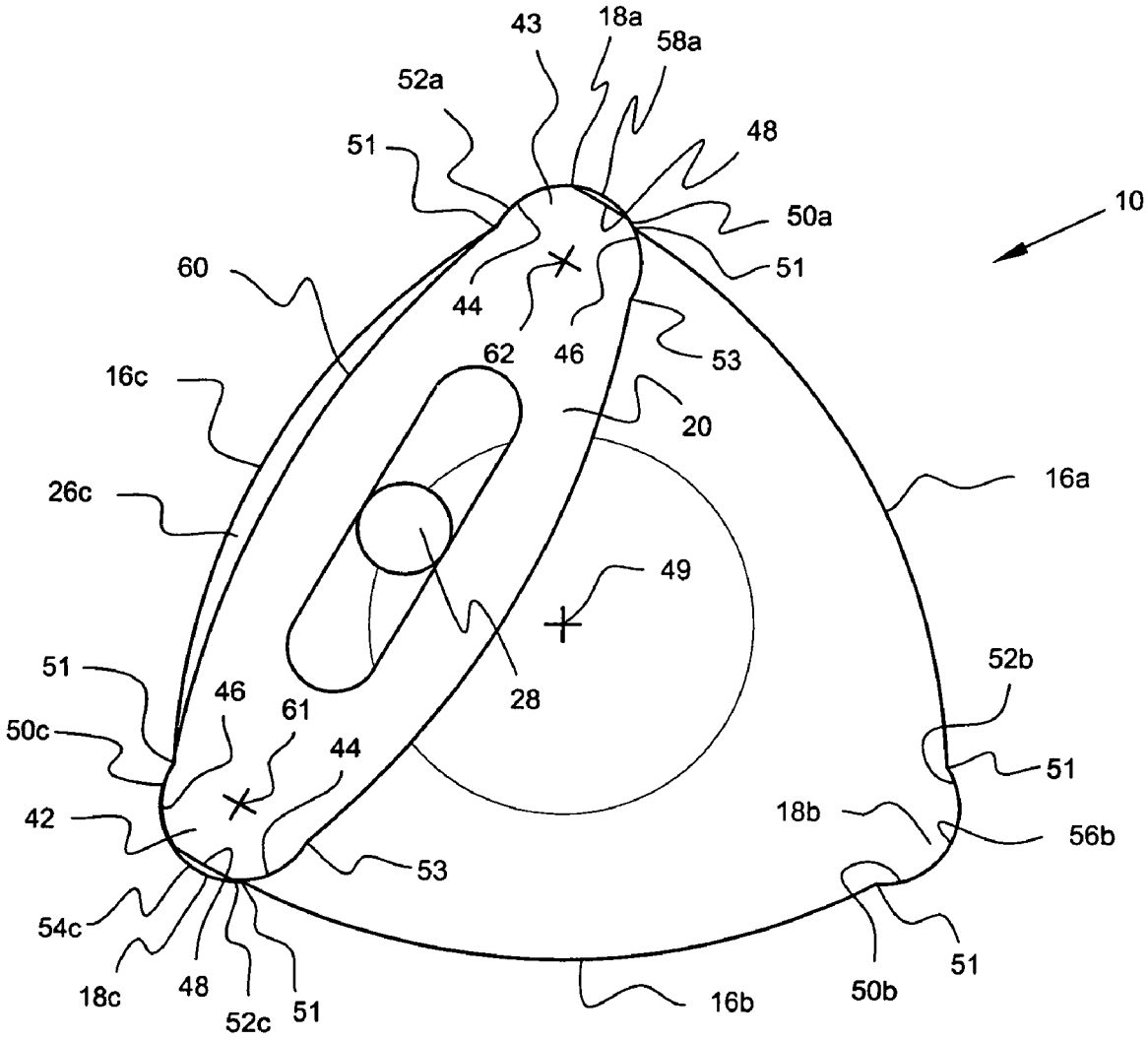
FIG. 6 depicts the rotary piston member in the cavity of the enclosure of FIG. 5, but with the rotary piston member rotated such that the first end of the rotary piston member engages the third arcuate recess, and such that the second end of the rotary piston member engages the first arcuate recess, thereby forming a compression chamber sealed via the two arcuate edges on the first end of the rotary piston member engaging cooperating portion of the first arcuate recess, and the two arcuate edges on the second end of the rotary piston member engaging cooperating portions of the first arcuate recess.

Referring to FIG. 6, the second end 43 of the piston member 20 has rotated counter-clockwise about the piston member first end center 61, such that the second end 43 of the piston member 20 engages the first arcuate recess 18*a*; whereupon, the piston member 20 rotation stops momentarily, the center of rotation of the piston member 20 changes back to the piston member second end center 62, the first arcuate edge portion 44 of the first end 42 disengages from the second edge portion 52*c*, of the third arcuate recess 18*c*, to allow the arcuate wall portion 48 of the first end 42 to ultimately engage the second arcuate side wall 16*b*, of the cavity 14, and the entire surface of the first arcuate edge portion 44 of the second end 43 engages the second edge portion 52*a*, of the first arcuate recess 18*a*, thereby providing a relatively small gap 54*c*, between the first end 42 and inner arcuate wall 56*c*, of the third arcuate recess 18*c*, and providing a relatively large seal area between the first end 42 and the third arcuate recess 18*c*. Further, when the piston member 20 momentarily stops rotation, the entire surface of the first arcuate edge portion 44 of the second end 43 engages the second edge portion 52*a*, of the first arcuate recess 18*a*, and the second arcuate edge portion 46 of the second end 43 remains disengaged from the first edge portion 50*a*, of the first arcuate recess 18*a*, thereby providing a relatively small gap 54*c*, between the first end 42 and an inner arcuate wall 56*c*, of the third arcuate recess 18*c*, and forming a compression chamber 26*c*, with a compressed fuel-air mixture therein pressurized to a predetermined magnitude between an arcuate wall portion 60 of the rotating piston member 20 and a corresponding second arcuate side wall 16*b*, of the cavity 14.

The compression chamber 26*c*, volume is minimized and the fuel-air mixture pressure maximized when the drive pin 28 is disposed at a midpoint of the piston member 20 and the first and second ends 42 and 43 of the piston member 20 engage the third and first arcuate recesses 18*c*, and a, thereby preventing the piston member 20 from locking during the compression and explosion sequence of the compression chamber 26*c*. Spark plugs 38*c*, then ignite the fuel-air mixture causing an "explosion" of the fuel-air mixture, resulting in the continuation of the forcible rotation of the piston member 20 in a counter-clockwise motion. The spent fuel-air mixture is ultimately removed from the cavity 14 via exhaust valves 40*c*.

Figure 7:
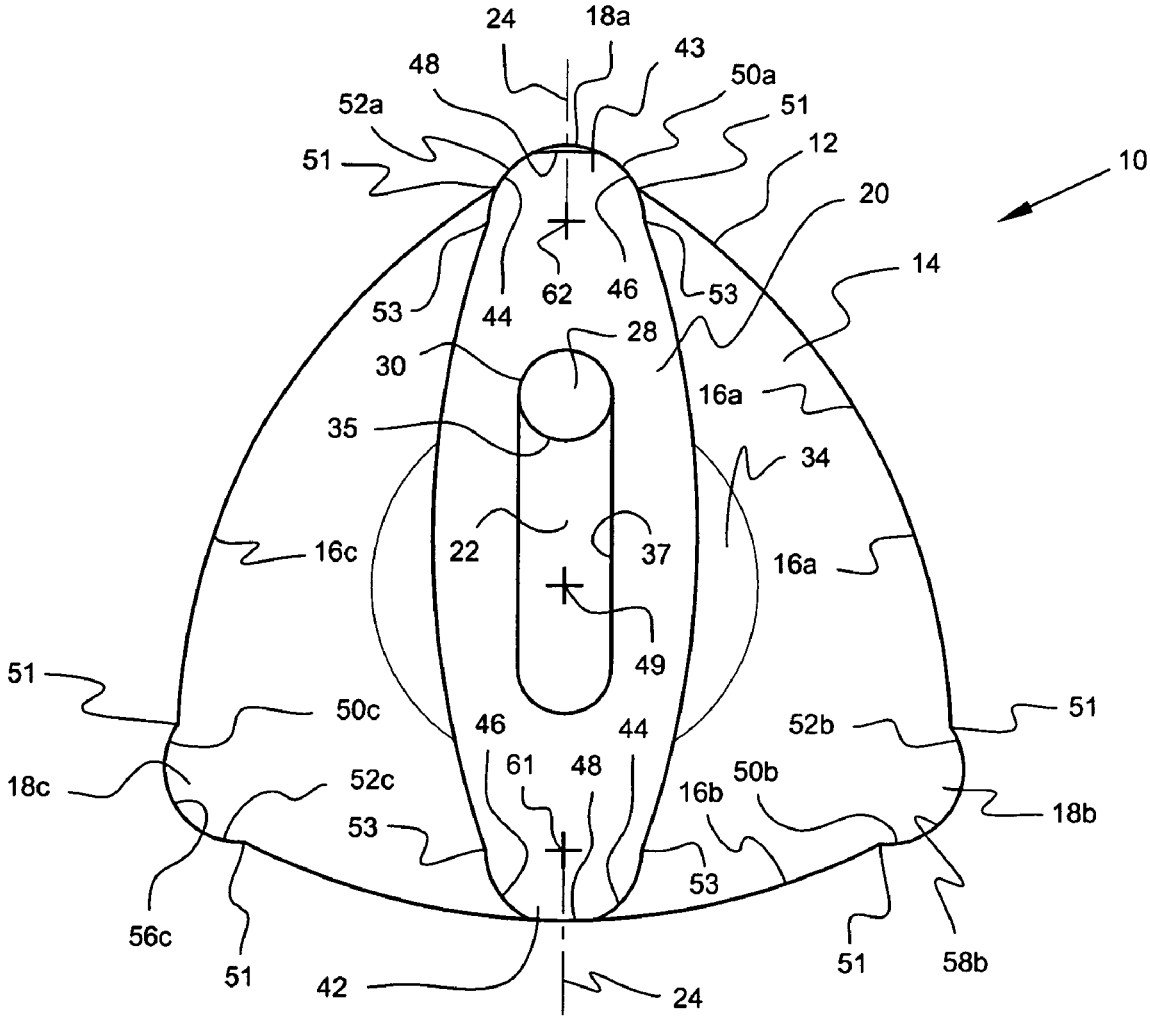
FIG. 7 depicts the rotary piston member in the cavity of the enclosure of FIG. 5, but with the rotary piston member rotated to a vertical position such that the longitudinal axis of the rotary piston member bisects the first arcuate recess and the second end of the rotary piston member in the first arcuate recess, the drive pin, and the first end of the rotary piston member engaging a mid-portion of the second arcuate side wall in accordance with the present invention.
Figure 8:
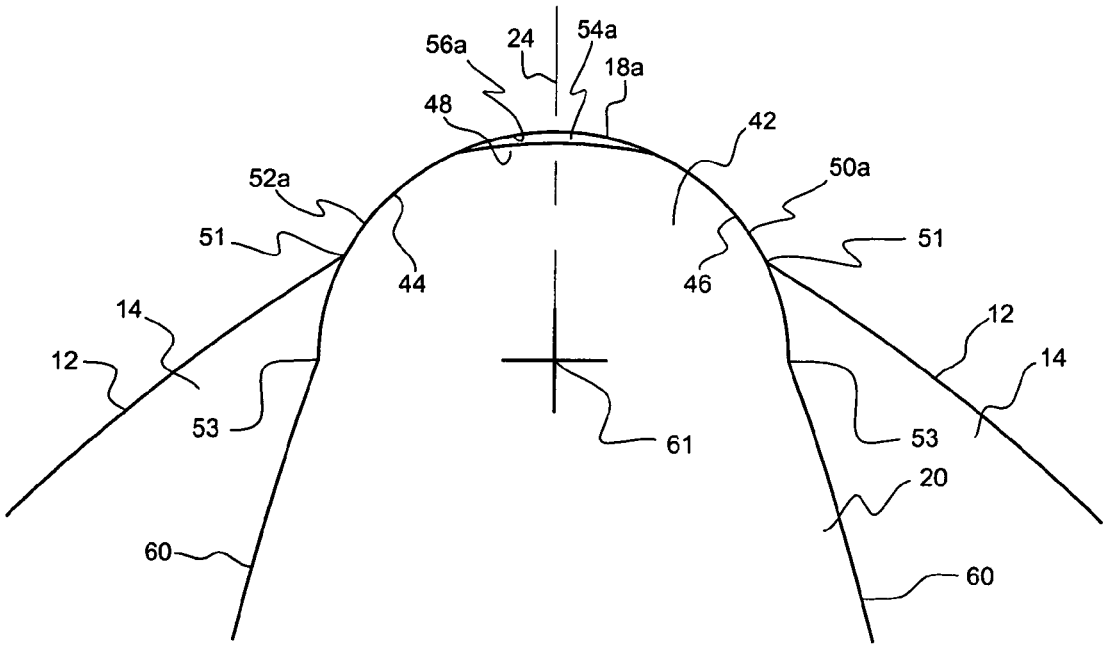
FIG. 8 depicts a partial view of the first end of the rotary piston member engaging the first arcuate recess of FIG. 1.
Figure 9:
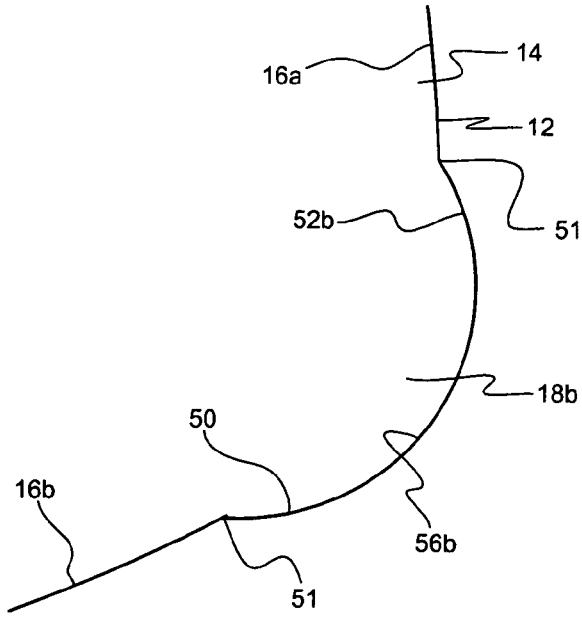
FIG. 9 depicts a partial view of the second arcuate recess of FIG. 1.
Figure 10:
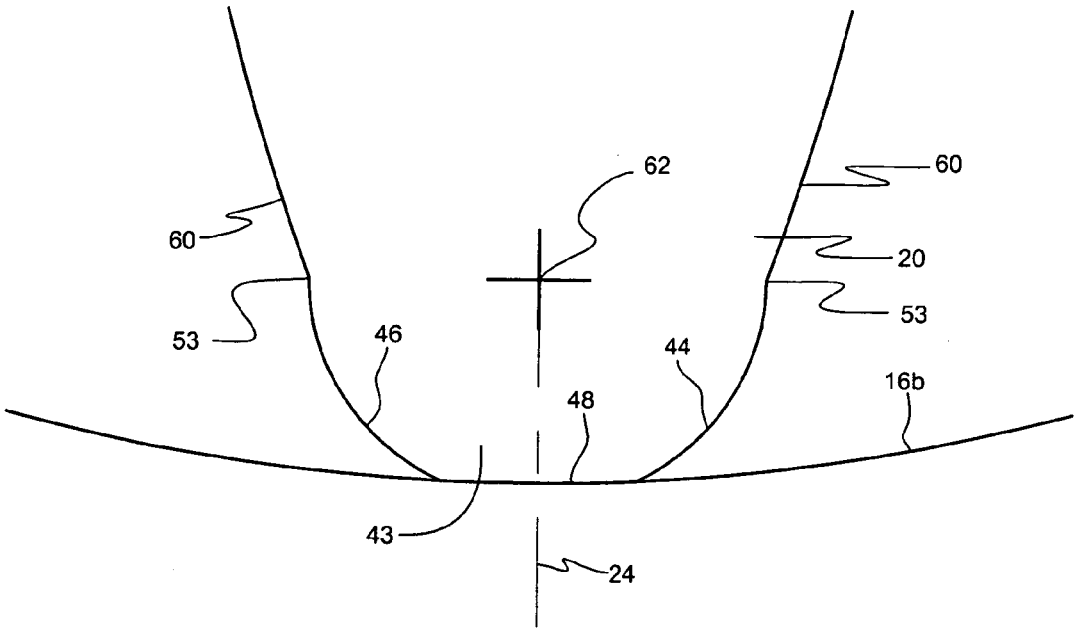
FIG. 10 depicts a partial view of the second end of the rotary piston member engaging the second arcuate side wall of FIG. 1.
Figure 11:
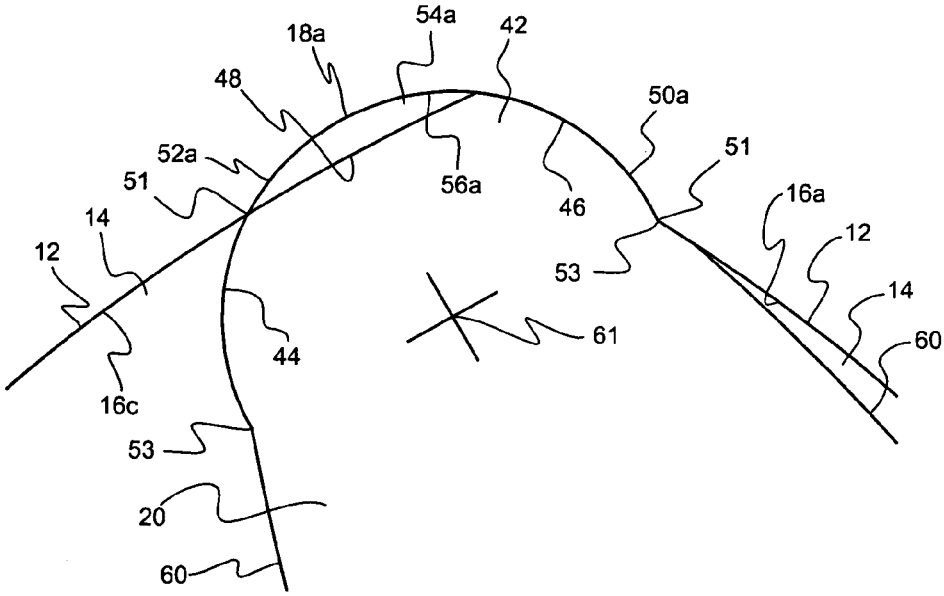
FIG. 11 depicts a partial view of the first end of the rotary piston member engaging the first arcuate recess of FIG. 2.
Figure 12:
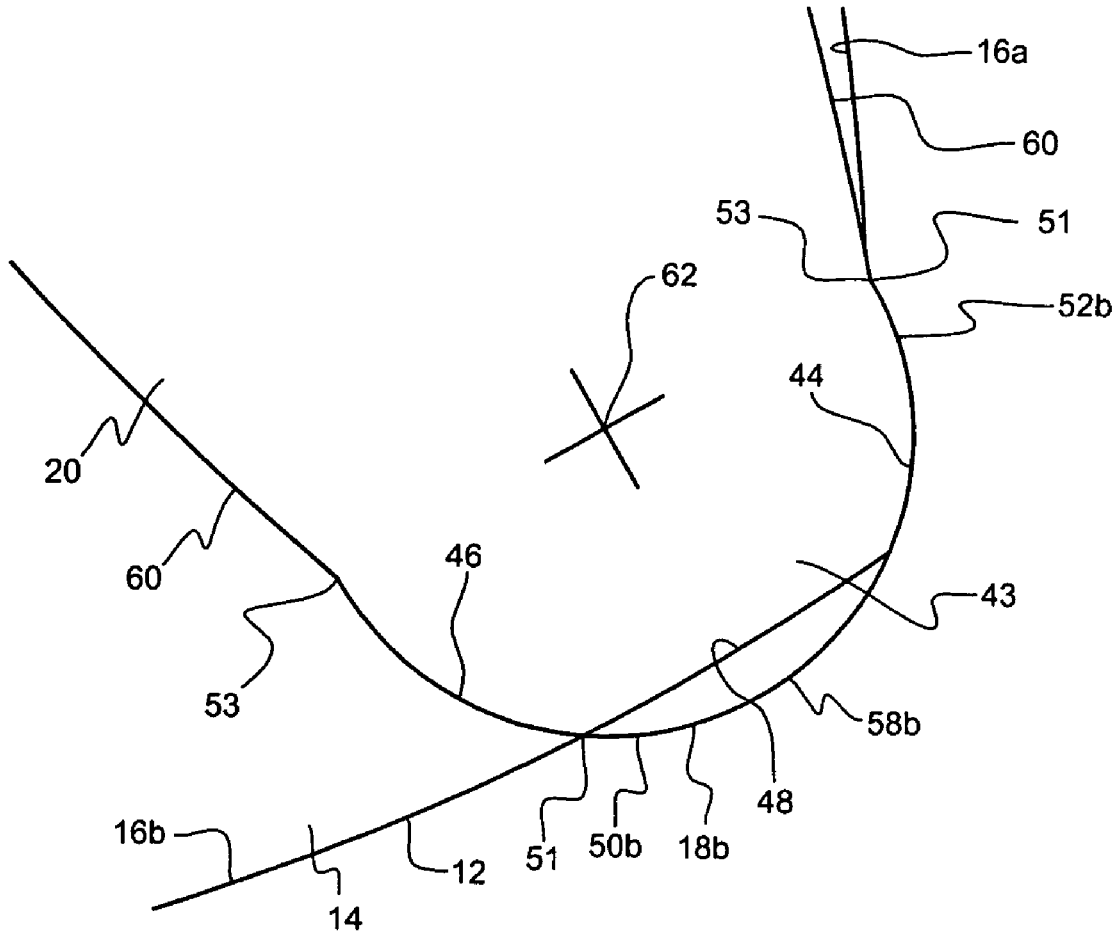
FIG. 12 depicts a partial view of the second end of the rotary piston member engaging the second arcuate recess of FIG. 2.
Figure 13:
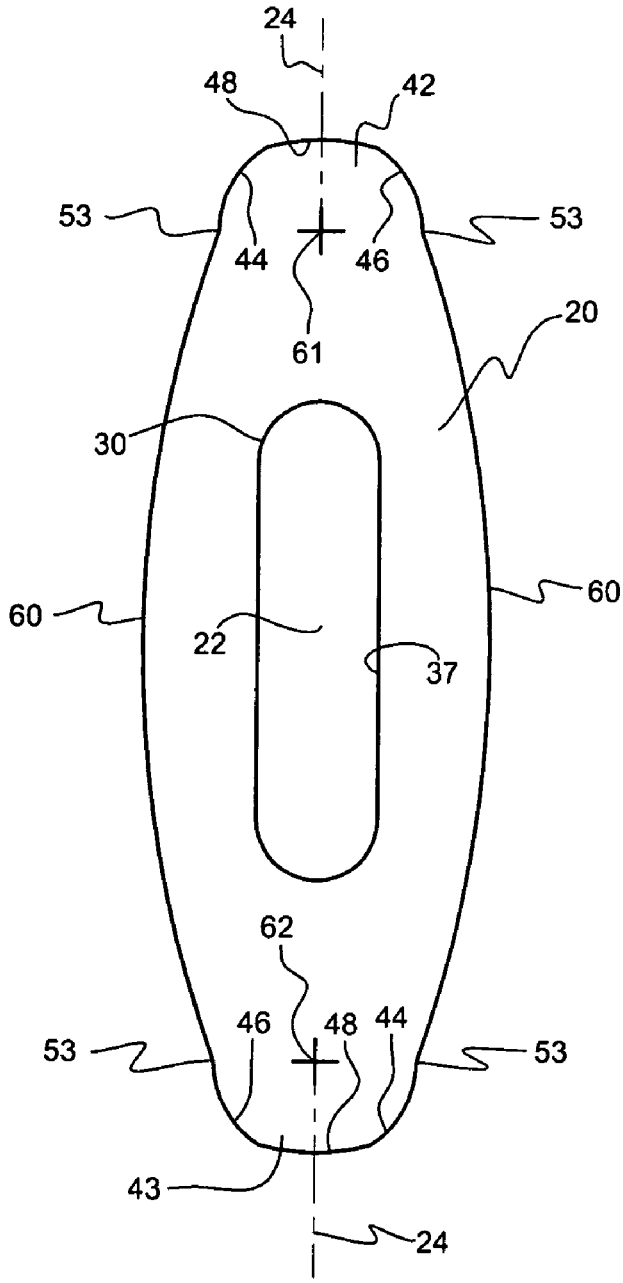
FIG. 13 depicts a view of the rotary piston member removed from the cavity in the enclosure.

Referring to FIG. 7, the piston member 20 has continued a counter-clockwise rotation about the second end center 62, resulting in a relatively slow rotation of the second end 43 of the piston member 20 about the inner arcuate wall 56*a*, of the first arcuate recess 18*a*, and a relatively fast movement of the first end 42 of the piston member 20 about the second arcuate side wall 16*b* of the cavity 14. The first arcuate edge portion 44 of the second end 43 of the piston member 20 is depicted engaging a second edge portion 52*a*, of the first arcuate recess 18*a*, and the second arcuate edge portion 46 is depicted engaging a first edge portion 50*a*, of the first arcuate recess 18*a*, thereby providing two seals between the second end 43 and the inner arcuate wall 56*a*, of the first arcuate recess 18*a*. The arcuate wall portion 48 of the first end 42 of the rotating piston member 20 is depicted cooperatively engaging the second arcuate side wall 16*b*, of the cavity 14, thereby providing a seal with a relatively large surface area between the first end 42 and the second arcuate side wall 16*b*.

The two relatively large seals of the second end 43 and the large surface area seal of the first end 42 prevent the "leaking" of a fuel-air mixture past the first and second ends 42 and 43, while the rotating piston member 20 compresses the fuel-air mixture supplied to the cavity 14 via intake valves 36*a*. The piston member 20 continues rotating until the first end 42 of the piston member 20 engages the second arcuate recess 18*b*, and the fuel-air mixture is compressed to a predetermined pressure. In the event that a relatively small quantity of fuel-air mixture should leak past the seal formed by the first arcuate edge portion 44 of the second end 43 and the second edge portion 52*a*, of the first arcuate recess 18*a*, during compression of the fuel-air mixture, the "leakage" quantity will be "vented" to and ultimately burned in compression chamber 26*a*, formed during the operation of the rotary piston machine 10.

The rotation of the piston member 20 depicted in FIGS. 1-7 is one hundred and eighty degrees, while the rotation of flywheel 34 is three hundred and sixty degrees. The cycle of the rotary piston machine 10 is then repeated as depicted in FIGS. 1-7, however, the positions of the first and second ends 42 and 43 of the piston member 20 are reversed relative to all the figures.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A rotary machine comprising:

an enclosure having a cavity with arcuate side walls, said cavity arcuate side walls defining a plurality of cavity arcuate recesses;

a piston member rotationally disposed in said cavity, said piston member having first and second ends configured to rotationally engage said cavity arcuate side walls and said cavity arcuate recesses such that a compression chamber is ultimately provided between said cavity arcuate side walls and said piston member, said first and second ends of said piston member ultimately engaging cooperating portions of said cavity arcuate recesses such that two seals are formed between each of said first and second ends of said piston member and said engaged cooperating portions of said cavity arcuate recesses;

wherein said piston member includes piston discontinuous transitions between said first and second ends of said piston member, and a side arcuate wall portion of said piston member;

said piston discontinuous transitions engaging said cooperating portions of said cavity arcuate recesses;

means for converting piston member movement into rotary motion imparted upon a flywheel;

means for supplying a working medium to predetermined portions of said cavity;

means for igniting said working medium; and means for removing said working medium after being ignited from predetermined portions of said cavity, whereby, said cavity arcuate side walls sequentially cooperate with said piston member to provide sequential compression chambers that ultimately receive said working medium to ultimately provide rotary motion to said flywheel, which provides rotary motion to a machine via a drive shaft.

2. The rotary machine of claim 1 wherein said cavity includes a predetermined axial dimension corresponding to a required power output from said rotary machine.

3. The rotary machine of claim 1 wherein said cavity arcuate recesses includes a cavity discontinuous transition between said cavity arcuate recesses and said cavity arcuate side wails.

4. The rotary machine of claim 1 wherein said first and second ends of said piston member comprise:

first and second arcuate edge portions; and arcuate end wall portions disposed between said first and second arcuate edge portions, said arcuate end wall portions engaging said cavity arcuate side walls.

5. The rotary machine of claim 4 wherein said first arcuate edge portion of said first end of said rotating piston member engages a second edge portion of a first cavity arcuate recess, and said second arcuate edge portion of said first end of said rotating piston member engages a first edge portion of said first cavity arcuate recess, while an arcuate end wall portion of said second end of said rotating piston member rotationally engages an opposite second cavity arcuate side wall, thereby providing two relatively large seals between said first end of said rotating piston member and said first cavity arcuate recess.

6. The rotary machine of claim 5 wherein said piston member ultimately rotates to a position that disposes said first end of said piston member such that said first arcuate edge portion of said first end disengages said second edge portion of said first cavity arcuate recess, and said second arcuate edge portion of said first end maintains engagement with said first edge portion of said first cavity arcuate recess; said piston member position disposing said second end of said piston member such that said first arcuate edge portion of said second end engages a second edge portion of a second cavity arcuate recess, and said second arcuate edge portion of said second end is disengaged from a first edge portion of said second cavity arcuate recess, resulting in a first compression chamber having one relatively large seal between each of said first and second ends of said rotating piston member and cooperating first and second cavity arcuate recesses, thereby allowing said arcuate end wall portion of said first end of said piston member to ultimately engage a third cavity arcuate side wall after a fuel-air mixture disposed in said first compression chamber explodes.

7. The rotary machine of claim 6 wherein said first arcuate edge portion of said second end of said rotating piston member engages a second edge portion of said second cavity arcuate recess, and said second arcuate edge portion of said second end of said rotating piston member engages a first edge portion of said second cavity arcuate recess, while an arcuate end wall portion of said first end of said rotating piston member rotationally engages said opposite third cavity arcuate side wall, thereby providing two relatively large seals between said second end of said rotating piston member and said second cavity arcuate recess.

8. The rotary machine of claim 7 wherein said piston member ultimately rotates to a position that disposes said second end of said piston member such that said first arcuate edge portion of said second end disengages said second edge portion of said second cavity arcuate recess, and said second arcuate edge portion of said second end maintains engagement with said first edge portion of said second cavity arcuate recess; said piston member position disposing said first end of said piston member such that said first arcuate edge portion of said first end engages a second edge portion of a third cavity arcuate recess, and said second arcuate edge portion of said first end is disengaged from a first edge portion of said third cavity arcuate recess, resulting in a second compression chamber having one relatively large seal between each of said first and second ends of said rotating piston member and cooperating third and second cavity arcuate recesses, thereby allowing said arcuate end wall portion of said second end of said piston member to ultimately engage said first cavity arcuate side wall after a fuel-air mixture disposed in said second compression chamber explodes.

9. The rotary machine of claim 8 wherein said first arcuate edge portion of said first end of said rotating piston member engages a second edge portion of said third cavity arcuate recess, and said second arcuate edge portion of said first end of said rotating piston member engages a first edge portion of said third cavity arcuate recess, while an arcuate end wall portion of said second end of said rotating piston member rotationally engages said opposite first cavity arcuate side wall, thereby providing two relatively large seals between said first end of said rotating piston member and said third cavity arcuate recess.

10. The rotary machine of claim 9 wherein said piston member ultimately rotates to a position that disposes said first end of said piston member such that said first arcuate edge portion of said first end disengages said second edge portion of said third cavity arcuate recess, and said second arcuate edge portion of said first end maintains engagement with said first edge portion of said third cavity arcuate recess; said piston member position disposing said second end of said piston member such that said first arcuate edge portion of said second end engages said second edge portion of said first cavity arcuate recess, and said second arcuate edge portion of said second end is disengaged from said first edge portion of said first cavity arcuate recess, resulting in a third compression chamber having one relatively large seal between each of said first and second ends of said rotating piston member and cooperating third and first cavity arcuate recesses, thereby allowing said arcuate end wall portion of said first end of said piston member to ultimately engage said second cavity arcuate side wall after a fuel-air mixture disposed in said third compression chamber explodes.

11. The rotary machine of claim 1 wherein said piston discontinuous transitions include a plurality of piston recesses that ultimately receive a cooperating discontinuity edge of first and second edge portions of said cavity arcuate recesses, thereby providing compression chambers with smaller volumes and higher compression ratios, and seals with larger surface areas formed by cooperating portions of said cavity arcuate recesses and said first and second arcuate edge portions of said first and second ends of said piston member, said larger surface area seals promoting tighter compression chambers that prevent a higher compressed air-fuel mixture therein from leaking from the compression chambers.

12. The rotary machine of claim 1 wherein said piston member includes a longitudinal slot axially aligned with a longitudinal axis of said piston member.

13. The rotary machine of claim 12 wherein said means for converting includes a drive pin having a first end slidably secured to said piston member via said longitudinal slot, and a second end secured to said flywheel, said drive pin moving lineally in alternating directions across said longitudinal slot, said drive pin cooperating with the rotary movement of said piston member to provide rotary motion to said flywheel.

14. The rotary machine of claim 13 wherein said drive pin includes and edge portion that slidably and rotationally engages a cooperating channel portion of said piston member.

15. The rotary machine of claim 13 wherein said compression chamber volume is minimized when said drive pin is disposed at a midpoint of said piston member, thereby preventing the locking of said piston member during the compression and explosion sequence of said rotary machine.

16. The rotary machine of claim 1 wherein said piston member includes a central annular aperture with a plate rotationally disposed therein.

17. The rotary machine of claim 16 wherein said means for converting includes a drive rod having a first end secured to said plate, and a second end secured to a flywheel, said first end of said drive rod moving annularly about said central annular aperture, said drive rod cooperating with the rotary movement of said piston member to provide rotary motion to said flywheel.

18. The rotary machine of claim 1 wherein said drive pin rotates annularly about a central axis of said flywheel.

19. The rotary machine of claim 18 wherein said annular rotation of said drive pin includes a circular configuration with a relatively large diameter, thereby minimizing the rotary force required to rotate said flywheel.

20. The rotary machine of claim 18 wherein said annular rotation of said drive pin promotes a relatively slow piston member movement when said piston member is disposed adjacent to said arcuate side walls of said cavity, thereby reducing the rate of volume increase of a combustion chamber after ignition of said working medium in said combustion chamber to prevent the rate of volume increase of said combustion chamber from reducing the amount of energy generated by an expanding working medium.

21. The rotary machine of claim 1 wherein said drive pin moves lineally relative to said rotating piston member.

22. The rotary machine of claim 1 wherein said piston member includes a relatively small lateral dimension to minimize piston member mass and to maximize a volume of said working medium that is ultimately compressed, thereby increasing power generated by said rotary machine without increasing the volume of said chamber.

23. The rotary machine of claim 1 wherein each one of a plurality valves are operated once during each rotation of said drive shaft.

24. A rotary motor comprising:

an enclosure having a cavity with a plurality of cavity arcuate side walls, said cavity arcuate side walls defining a plurality of cavity arcuate recesses, said cavity arcuate side walls being separated by said cavity arcuate recesses, said cavity arcuate recesses including first and second edge portions that provide cavity discontinuous transition between said cavity arcuate recesses and said cavity arcuate side walls;

a piston member rotationally disposed in said cavity, said piston member having first and second ends configured to rotationally engage said cavity arcuate side walls and said cavity arcuate recesses such that compression chambers are ultimately provided between said cavity arcuate side walls and said piston member, said compression chambers including seals between said piston member first and second ends and said cavity arcuate recesses, said seals forming gaps between said first and second ends and said cavity arcuate recesses, said gaps being filled with a sealing lubricant to prevent compressed fuel-air mixtures from leaking from said compression chambers;

wherein said piston member includes piston discontinuous transitions between said first and second ends of said piston member, and a side arcuate wall portion of said piston member;

said piston discontinuous transitions ultimately receiving said cavity discontinuous transitions;

means for converting drive shaft movement into rotary motion imparted upon said piston member;

means for providing rotary motion to said drive shaft;

means for supplying a selected medium to said chamber; and means for removing the selected medium from said chamber after the selected medium has imparted rotary motion upon said rotating piston member.

25. The rotary motor of claim 24 wherein said first and second ends of said piston member comprises:

first and second arcuate edge portions; and arcuate end wall portions disposed between said first and second arcuate edge portions, said arcuate end wall portions engaging said cavity arcuate side walls.

26. The rotary motor of claim 24 wherein a first arcuate edge portion of said first end of said rotating piston member engages a second edge portion of a first cavity arcuate recess, and a second arcuate edge portion of said first end of said rotating piston member engages a first edge portion of said first cavity arcuate recess, while an arcuate end wall portion of said second end of said rotating piston member rotationally engages an opposite second cavity arcuate side wall, thereby providing two seals between said first end of said rotating piston member and said first cavity arcuate recess.

27. The rotary motor of claim 24 wherein said means for providing rotary motion includes a drive pin having a first end slidably secured to said piston member via a slot, and a second end secured to a flywheel, said drive pin cooperating with the rotary movement of said flywheel to provide rotary motion to said piston member within said cavity.

28. A method for providing a rotary piston machine, said method comprising the step of:

providing an enclosure having a cavity with arcuate side walls, said cavity arcuate side walls defining a plurality of cavity arcuate recesses with discontinuity edges which provide a cavity discontinuous transition between said cavity arcuate recesses and said cavity arcuate side walls;

providing a piston member rotationally disposed in said cavity, said piston member having end portions configured to rotationally engage said cavity arcuate side walls and said cavity arcuate recesses such that a compression chamber is ultimately provided between said cavity arcuate side walls and said piston member, said end portions of said piston member including first and second arcuate edge portions that ultimately engage cooperating portions of said cavity arcuate recesses, said first and second piston arcuate edge portions of said piston end portions of said piston member being separated by a piston arcuate end wall portion that is ultimately disposed adjacent to said cavity arcuate side walls during the rotation of said piston member, said piston member including piston discontinuous transitions between said first and second ends, and a piston arcuate side wall portion, said piston discontinuous transitions ultimately receiving said cavity discontinuous transitions of said cavity arcuate side walls;

converting said piston member movement into rotary motion imparted upon a flywheel;

supplying a working medium to predetermined portions of said cavity;

igniting said working medium via a plurality of igniters; and removing said working medium from predetermined portions of said cavity, whereby, said arcuate side walls of said cavity sequentially cooperate with said piston member to provide sequential compression chambers that ultimately receive said working medium to ultimately provide rotary motion to said flywheel, which provides rotary motion to a machine via a drive shaft.

* * * * *